United States Patent [19]

Ruger

[11] Patent Number: 4,766,687

[45] Date of Patent: Aug. 30, 1988

[54] TRIGGER AND TRIGGER GUARD SPRING SYSTEM

[75] Inventor: William B. Ruger, Croydon, N.H.

[73] Assignee: Sturm, Ruger & Company, Inc., Southport, Conn.

[21] Appl. No.: 933,421

[22] Filed: Nov. 21, 1986

Related U.S. Application Data

[63] Continuation of Ser. No. 716,739, Mar. 27, 1985, abandoned.

[51] Int. Cl.[4] ..... F41C 1/00; F41C 19/00; F41C 23/00

[52] U.S. Cl. ..... 42/65; 42/59; 42/71.02

[58] Field of Search ..... D22/104; 42/71.02, 65, 42/59, 7

[56] References Cited

U.S. PATENT DOCUMENTS

| | | | |
|---|---|---|---|
| D. 260,799 | 9/1981 | Bianchi | D22/104 |
| 1,279,372 | 9/1918 | Lemple | 42/71.02 |
| 2,081,438 | 10/1935 | Pomeroy | 42/71.02 |
| 3,176,423 | 4/1965 | Gerber | 42/65 |
| 3,654,720 | 4/1972 | Ruger | 42/59 |
| 4,213,263 | 7/1980 | Brouthers | 42/59 |
| 4,378,651 | 4/1983 | Pachmayr et al. | 42/71.02 |

*Primary Examiner*—Charles T. Jordan
*Assistant Examiner*—Michael J. Carone
*Attorney, Agent, or Firm*—Pennie & Edmonds

[57] ABSTRACT

The present invention comprises a handgun having a frame, a trigger, a removable trigger guard mounted on the frame through a releasable latch mounted on the trigger guard and engageable with the frame wherein a spring mounted on the trigger guard urges (a) the latch to its frame engagement position and (b) urges the trigger to its at rest position.

It is a feature of the invention that as the trigger is pulled to move it from its at rest position to its fire position the trigger guard latch arrangement is subjected to greater force thus increasing the force necessary to separate the frame and the guard and avoiding inadvertent detachment during recoil.

It is also a feature of the invention that the rearward portion of the trigger guard is so shaped and configured to mate exactly with the handgun's grips, thus avoiding gaps between the grips and trigger guard which must occur in the use of conventionally shaped trigger guards, and which can pinch portions of the user's fingers.

5 Claims, 5 Drawing Sheets

TRIGGER AND TRIGGER GUARD SPRING SYSTEM

RELATED APPLICATION

This is a continuation of U.S. patent application Ser. No. 716,739, entitled "Trigger And Trigger Guard Spring System", filed Mar. 27, 1985, now abandoned.

BACKGROUND OF THE INVENTION

Prior arrangements for handguns have been proposed in which the trigger spring is used to perform additional functions in the operation of the gun (U.S. Ruger Pat. No. 4,067,131). Spring loaded attachments have been proposed for trigger guards for use with easier disassembly (U.S. Ruger Pat. No. 3,654,720).

Prior arrangements in handguns for the ready removal and disassembly of trigger guards have not; however, satisfactorily provided for adequate integrity during operation, ease of removal for assembly, and simplicity of design.

Also, the shape of the rearward portions of detachable trigger guards has been such that exact mating of the trigger guard and grips of the handgun has been impossible in normal manufacture.

SUMMARY OF THE INVENTION

Broadly, the present invention comprises a handgun having a frame, a trigger, a removable trigger guard mounted on the frame through a releasable latch mounted on the trigger guard and engageable with the frame wherein spring means mounted on the trigger guard urges (a) the latch to its frame engagement position and (b) urges the trigger to its at rest position.

It is a feature of the invention that as the trigger is pulled to move it from its at rest position to its fire position the trigger guard latch arrangement is subjected to greater force thus increasing the force necessary to separate the frame and the guard and avoiding inadvertent detachment during recoil.

It is also a feature of the invention that the rearward portion of the trigger guard is so shaped and configured to mate exactly with the handgun's grips, thus avoiding gaps between the grips and trigger guard which must occur in the the use of conventionally shaped trigger guards, and which can pinch portions of the user's fingers.

DESCRIPTION OF THE PREFERRED EMBODIMENT

Figures 1, 2:
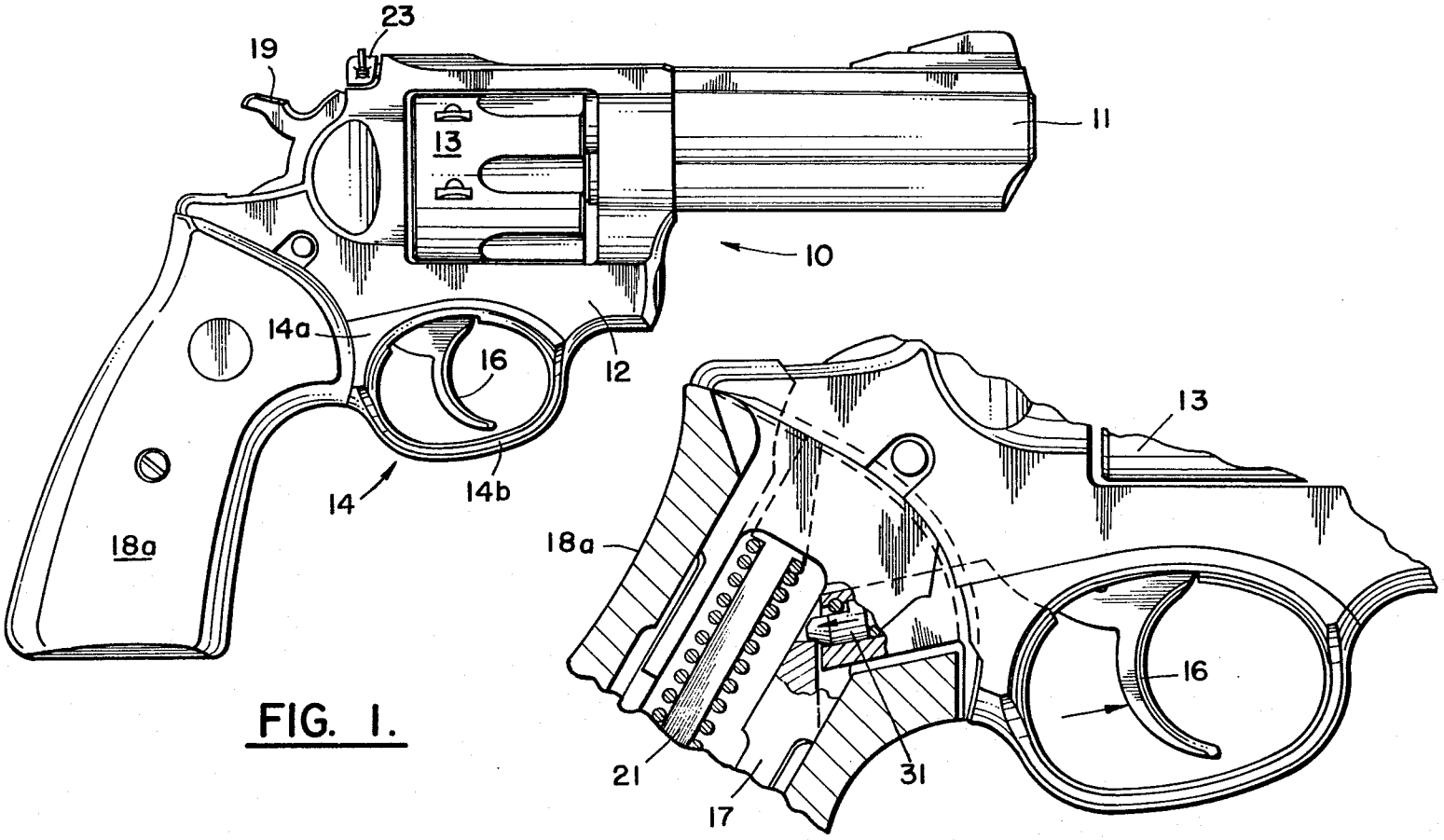
FIG. 1 is a side elevational view of the revolver of the invention.
FIG. 2 is an enlarged partially broken away elevational view of showing the trigger guard latch and hammer spring arrangement.
Figure 3:
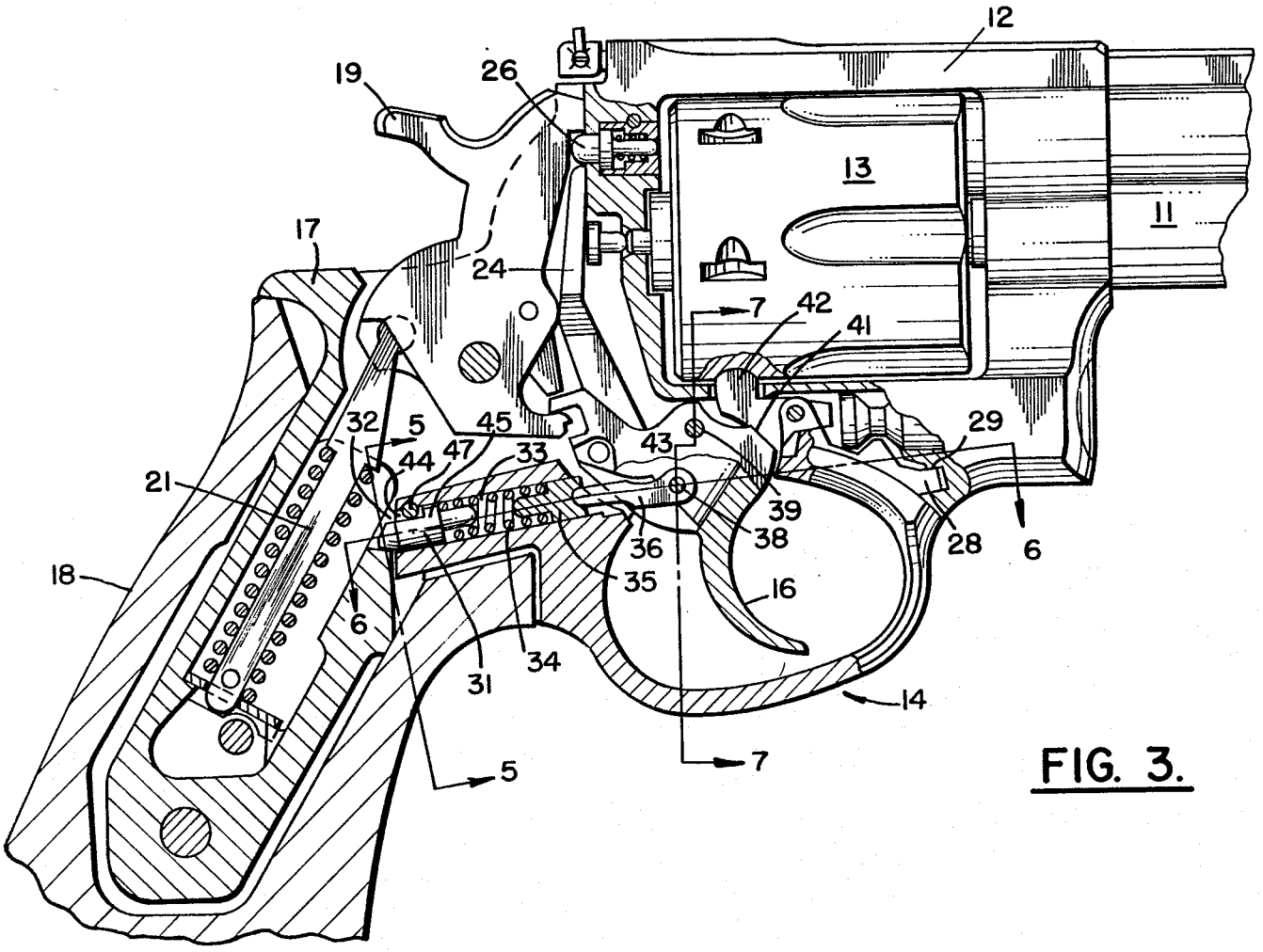
FIG. 3 is a partial side elevational view of the revolver with portions broken away showing the trigger in its rest position.

In FIGS. 1, 2, and 3, revolver 10 includes barrel 11, frame 12, cylinder 13, trigger guard 14 including trigger guard housing **14*a* and trigger guard band 14*b*, trigger 16, handle 17 and handle grips 18*a*, 18*b*. Also shown are hammer 19, hammer strut 21 and hammer spring 22, rear sight 23, transfer bar 24 and firing pin 26**.

Figure 4:
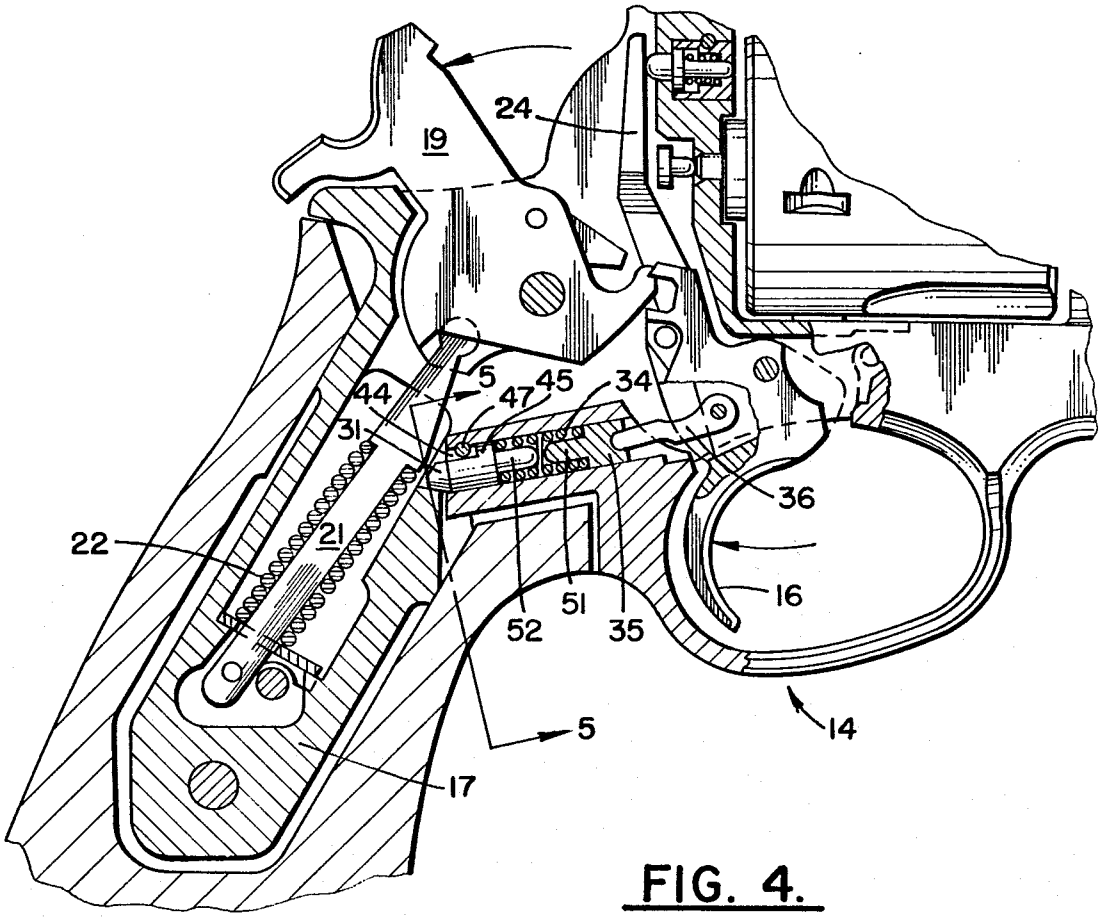
FIG. 4 is a partial side elevational view of the revolver with portions broken away showing the trigger in its pulled position.

Turning to FIGS. 3 and 4, trigger guard 14 is releasably engageable with frame 12 through (1) forward trigger guard lug 28 which is received in frame lug recess 29, and (2) spring loaded rearward detent 31 which is received by handle recess 32 in handle 17. Detent 31 is slidably mounted in trigger guard passageway 33 and is biased rearwardly by coil spring 34 which engages guard slide piece 35 also slidable in passageway 33. Trigger strut 36 is pivotally connected to trigger 16 about pin 38. Trigger 16 is mounted on frame 12 through trigger pivot pin 39 and trigger 16 is biased forwardly to its at rest position by action of spring 34 and strut 36. Strut 36 engages slide 35 in slide end hollow 43 to accommodate for slight change in orientation of strut 36 during operation of trigger 16. In its rest position, trigger 16's rotation about pin 39 counterclockwise is limited by trigger face 41 engagement cylinder latch 42.

Figure 5:
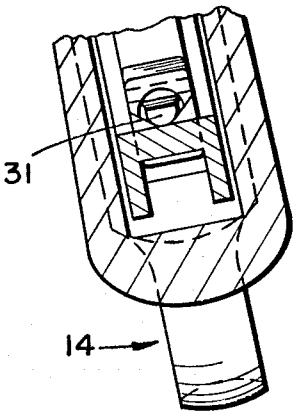
FIG. 5 is a sectional view along line 5—5 of FIGS. 3 and 4.

Turning now to FIGS. 4 and 5, it is seen that as trigger 16 is pulled back spring 34 is compressed through rearward movement of strut 36, in turn causing slide 35 to move rearwardly against spring 34. Since detent 31 is unable to move further rearwardly in recess 32, the force holding detent 31 in handle recess 32 is increased as the trigger 16 is pulled thus increasing the forces required to cause trigger guard 14 to be released from the frame 12 during handling or firing of the revolver.

Detent 31 includes a notched portion 44, retaining lip 45 for engaging retaining pin 47 to prevent detent 31 from exiting passageway 33 under urging of spring 34 upon disassembly of the trigger guard 14. Coil spring 34 is mounted around slide projection 51 forming a part of slide 35 at its rearward end and around detent projection 52 formed at the forward end of detent 31 (see also FIG. 6).

Figure 6:
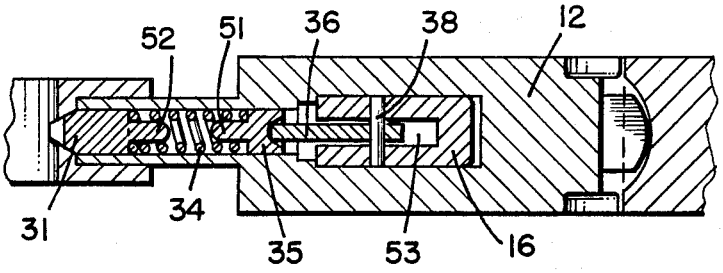
FIG. 6 is a sectional view along line 6—6 of FIG. 3.
Figure 7:
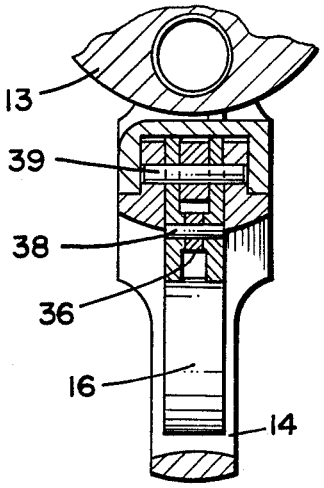
FIG. 7 is a sectional view along line 7—7 of FIG. 3.
Figure 8:
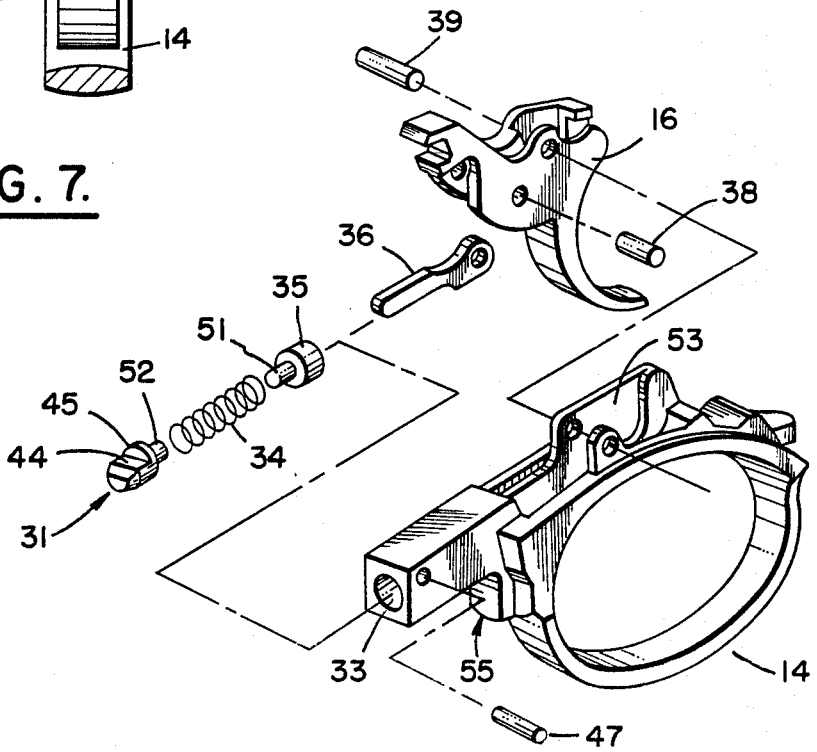
FIG. 8 is an exploded view showing the trigger guard, trigger and associated parts.

Turning to FIGS. 6, 7, and 8, the preferred embodiment is further shown including an exploded view. It is seen that trigger 16 includes a trigger recess 53 to accommodate strut 36 as mounted on pin 38 (see FIGS. 6 and 8).

Figure 9:
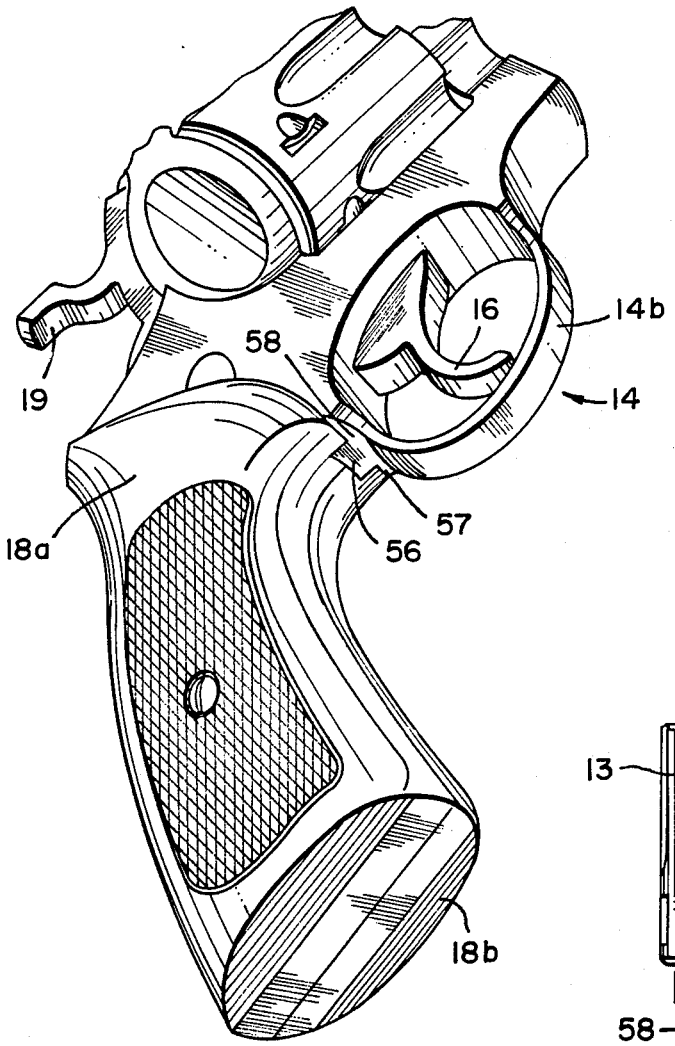
FIG. 9 is a partial perspective view of the revolver showing the trigger guard and its engagement with the handle grips.
Figure 10:
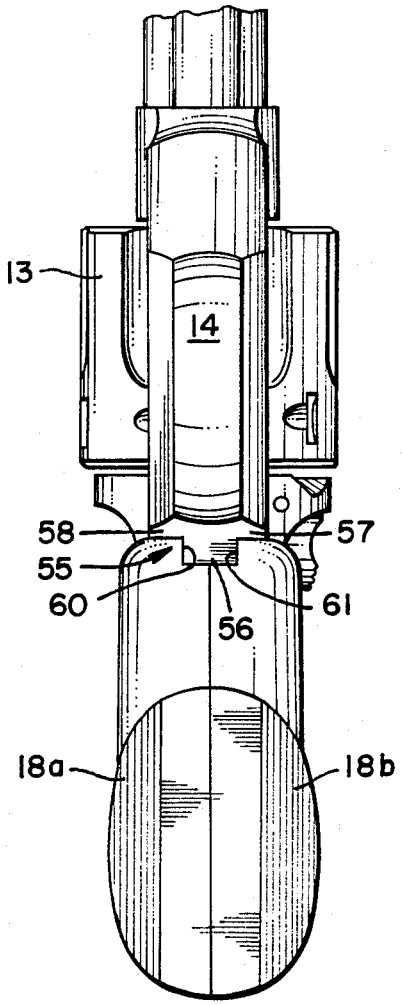
FIG. 10 is a partial bottom view of the revolver.

Turning finally to FIGS. 9 and 10, trigger guard 14 includes rearward trigger housing section 55 (see also FIG. 8) which housing section 55 further includes center section 56 and side sections 57, 58. Center section 56 extends rearwardly further than side sections 57, 58. Center section 56 fits into and is received by half-notch 60 in left-hand grip **18*a* and half-notch 61 in right-hand grip 18*b*. The trigger guard housing 14*a* with it center section 56 together with complementary hand grip notches 60, 61 provide revolver 10 with a continuous curvature from the guard band 14*b* rearwardly to grips 18*a*, 18*b*. This structural feature provides a continuous curvature line along the underside of the revolver from the guard band 14*b* to and including the handle grips 18*a*, 18*b*, which is impossible with conventional revolvers because the rear of their trigger guards are fitted to the metal grip frames, instead of the grips themselves, as in the described invention. The grips of conventional revolvers, if they are of the "wraparound" style which cover the metal grip frame, must necessarily overlap the grip frame and therefore will always create a gap between the rear of the trigger guard and the front lower portion of the grips, approximately in area 56. No gap or opening is formed between trigger guard 14 and the revolver handle into which a portion of the gun operator's finger could be lodged and subsequently pinched by recoil of the revolver, because the invention provides for exact flush fit of the rear of the guard (56, 57, 58**) and the overlapping grip.

I claim:

1. In a handgun having a frame, a detachable trigger guard mounted on the frame, and a trigger pivotally mounted on the trigger guard, the improvement comprising (a) first latch means for engaging a forward portion of the trigger guard to the frame;

(b) second latch means for engaging a rearward portion of the trigger guard to the frame including a latch-receiving recess in the frame; the second latch means in turn comprising:

(i) strut means pivotally mounted on trigger;

(ii) spring means on the trigger guard urging the strut means forward to place the trigger in a biased-forward position; and (iii) releasable latch means on the trigger guard which latch means is urged into the said latch-receiving recess in the frame by said spring means;

(iv) trigger pivot means on the trigger guard about which the trigger rotates as the trigger moves rearwardly carrying the strut means to compress the spring means to in turn increase the forces with which the detachable trigger guard is held in the frame;

whereby said spring means simultaneously biases the trigger and the releasable latch means and whereby the pulling of the trigger in a rearward direction increases the biasing force on the releasable latch means.

2. The improvement of claim 1 in which the second latch means is housed in trigger guard passageway and further includes a slide means and slidable detent means each such means slidably mounted in said passageway and each such means urged apart by said spring means.

3. The improvement of claim 2 in which the detent means is prevented from exiting the passageway by detent limit means whereby upon disassembly of the trigger guard the detent means will remain in the guard passageway.

4. In a handgun having a frame, a handle, handle grips on the handle and a trigger guard, the improvement comprising (a) a trigger housing and a trigger guard band forming the trigger guard;

(b) the trigger housing including a rearward housing section having a recess therein for housing the handle grips in such housing shaped to provide a first continuous curvature surface; and (c) the housing recess having an abutting surface;

(d) such handle grips positioned in the housing recess and formed to have a complementary abutting surface to abut said recess abutting surface such abutting surfaces extending a substantial distance from said first continuous curvature surface and such handle grips protruding below the frame such substantial distance in such housing recess to define a second continuous lower curvature surface below and spaced from the frame such distance, such first and second curvature surfaces abuttingly engaging to define a third continuous curvature surface along the underside of the handgun.

5. The improvement of claim 4 in which the rearward trigger housing section includes a center tab section positioned in the housing recess and positioned in notches in the grips.

* * * * *